US010530047B2

(12) United States Patent
Pan et al.

(10) Patent No.: US 10,530,047 B2
(45) Date of Patent: Jan. 7, 2020

(54) BROADBAND WAVEGUIDE LAUNCH DESIGNS ON SINGLE LAYER PCB

(71) Applicant: Waymo LLC, Mountain View, CA (US)

(72) Inventors: Helen K. Pan, Saratoga, CA (US); Adam Brown, Mountain View, CA (US); Edward McCloskey, Los Gatos, CA (US)

(73) Assignee: Waymo LLC, Mountain View, CA (US)

( * ) Notice: Subject to any disclaimer, the term of this patent is extended or adjusted under 35 U.S.C. 154(b) by 183 days.

(21) Appl. No.: 15/603,978

(22) Filed: May 24, 2017

(65) Prior Publication Data

US 2018/0342797 A1 Nov. 29, 2018

(51) Int. Cl.

| | |
|---|---|
| ***H01Q 1/38*** | (2006.01) |
| ***H01Q 7/00*** | (2006.01) |
| ***H01Q 9/04*** | (2006.01) |
| *H01Q 1/32* | (2006.01) |

(52) U.S. Cl.

CPC ..... *H01Q 1/38* (2013.01); *H01Q 7/00* (2013.01); *H01Q 9/0407* (2013.01); *H01Q 1/3233* (2013.01)

(58) Field of Classification Search

CPC ..... H01Q 1/38; H01Q 7/00; H01Q 9/0407

USPC ..... 343/870

See application file for complete search history.

(56) References Cited

U.S. PATENT DOCUMENTS

| | | | | |
|---|---|---|---|---|
| 6,476,557 | B1 * | 11/2002 | Leng | H01J 61/12 313/161 |
| 6,559,809 | B1 * | 5/2003 | Mohammadian | H01Q 1/243 343/702 |
| 9,647,313 | B2 * | 5/2017 | Marconi | H01P 5/107 |
| 10,003,117 | B2 * | 6/2018 | Natsuhara | H01P 5/107 |
| 2003/0179147 | A1 * | 9/2003 | King | H01Q 1/247 343/786 |
| 2006/0152406 | A1 * | 7/2006 | Leblanc | G01S 7/032 342/175 |
| 2010/0066631 | A1 * | 3/2010 | Puzella | H01Q 1/02 343/853 |
| 2011/0199265 | A1 * | 8/2011 | Lin | H01Q 1/2266 343/700 MS |
| 2013/0157601 | A1 * | 6/2013 | O'Keeffee | H01Q 3/267 455/226.1 |

(Continued)

FOREIGN PATENT DOCUMENTS

EP 2267541 A1 * 12/2010

*Primary Examiner* — Huedung X Mancuso

(74) *Attorney, Agent, or Firm* — McDonnell Boehnen Hulbert & Berghoff LLP

(57) ABSTRACT

The present application discloses embodiments that relate to an electromagnetic apparatus. In one aspect, the present apparatus includes a circuit board configured to propagate an electromagnetic signal, a waveguide configured to propagate an electromagnetic signal, and a coupling port configured to couple the electromagnetic signal between the circuit board and the waveguide. The apparatus further includes a radiating structure disposed on the circuit board. The radiating structure includes an electric field coupling component configured to an electric field between the circuit board and the coupling port and a magnetic field coupling component configured to couple a magnetic field between the circuit board and the coupling port.

17 Claims, 12 Drawing Sheets

(56) References Cited

U.S. PATENT DOCUMENTS

| | | | | |
|---|---|---|---|---|
| 2014/0022742 | A1* | 1/2014 | Shen | H05K 1/18 361/748 |
| 2014/0104129 | A1* | 4/2014 | Chen | H01Q 1/243 343/850 |
| 2015/0015453 | A1* | 1/2015 | Puzella | H01Q 21/0025 343/853 |
| 2015/0022417 | A1* | 1/2015 | Pan | H01Q 1/48 343/843 |
| 2015/0364804 | A1* | 12/2015 | Tong | G01S 7/032 342/175 |
| 2017/0201028 | A1* | 7/2017 | Eberhardt | H01P 3/06 |
| 2017/0324143 | A1* | 11/2017 | Talty | H01Q 1/1271 |
| 2018/0262040 | A1* | 9/2018 | Contopanagos | H01Q 1/364 |
| 2018/0342797 | A1* | 11/2018 | Pan | H01Q 9/0407 |

* cited by examiner

BROADBAND WAVEGUIDE LAUNCH DESIGNS ON SINGLE LAYER PCB

BACKGROUND

Unless otherwise indicated herein, the materials described in this section are not prior art to the claims in this application and are not admitted to be prior art by inclusion in this section.

Radio detection and ranging (RADAR) systems can be used to actively estimate distances to environmental features by emitting radio signals and detecting returning reflected signals. Distances to radio-reflective features can be determined according to the time delay between transmission and reception. The radar system can emit a signal that varies in frequency over time, such as a signal with a time-varying frequency ramp, and then relate the difference in frequency between the emitted signal and the reflected signal to a range estimate. Some systems may also estimate relative motion of reflective objects based on Doppler frequency shifts in the received reflected signals. Directional antennas can be used for the transmission and/or reception of signals to associate each range estimate with a bearing. More generally, directional antennas can also be used to focus radiated energy on a given field of view of interest. Combining the measured distances and the directional information allows for the surrounding environment features to be mapped. The radar sensor can thus be used, for instance, by an autonomous vehicle control system to avoid obstacles indicated by the sensor information.

Some example automotive radar systems may be configured to operate at an electromagnetic wave frequency of 77 Giga-Hertz (GHz), which corresponds to millimeter (mm) electromagnetic wavelength (e.g., 3.9 mm for 77 GHz). These radar systems may use antennas that can focus the radiated energy into tight beams in order to enable the radar system to measure an environment with high accuracy, such as an environment around an autonomous vehicle. Such antennas may be compact (typically with rectangular form factors; e.g., 1.3 inches high by 2.5 inches wide), efficient (e.g., with little 77 GHz energy lost to heat in the antenna, or reflected back into the transmitter electronics), and inexpensive to manufacture.

SUMMARY

The present application discloses embodiments that relate to an electromagnetic apparatus. In one aspect, the present apparatus includes a circuit board configured to propagate an electromagnetic signal. The apparatus also includes a waveguide configured to propagate an electromagnetic signal. The apparatus further includes a coupling port configured to couple the electromagnetic signal between the circuit board and the waveguide. The circuit board is proximate to the coupling port. Additionally, the apparatus includes a radiating structure disposed on the circuit board. The radiating structure includes an electric field coupling component and a magnetic field coupling component. The electric field coupling component is configured to couple an electric field between the circuit board and the coupling port, and the magnetic field coupling component is configured to couple a magnetic field between the circuit board and the coupling port.

In another aspect, the present application describes a method. The method involves conducting electromagnetic energy by a circuit board. The circuit board is proximate to a coupling port of a waveguide. The method further includes radiating at least a portion of the electromagnetic energy as radiated electromagnetic energy by a radiating structure disposed on the circuit board. The radiating structure includes an electric field coupling component and a magnetic field coupling component. The method also includes coupling at least a portion of the radiated electromagnetic energy into the waveguide via the coupling port. Coupling the portion of the radiated electromagnetic energy into the waveguide via the coupling port includes coupling an electric field from the circuit board into the coupling port by the electric field coupling component and coupling a magnetic field from the circuit board into the coupling port by the magnetic field coupling component.

In yet another aspect, the present application describes another method. The method may include propagating electromagnetic energy by a waveguide. The method also includes receiving at least a portion of the electromagnetic energy from the waveguide into a coupling port as received electromagnetic energy. Additionally, the method includes coupling at least a portion of the received electromagnetic energy from the coupling port to a circuit board. Coupling the portion of the received electromagnetic energy from the coupling port to the circuit board includes coupling an electric field from the coupling port to the circuit board by an electric field coupling component disposed on the circuit board and coupling a magnetic field from the coupling portion to the circuit board by a magnetic field coupling component disposed on the circuit board.

In still another aspect, a system is provided that includes means for propagating electromagnetic energy by a waveguide. The system also includes means for receiving at least a portion of the electromagnetic energy from the waveguide as received electromagnetic energy. Additionally, the system includes means for coupling at least a portion of the received electromagnetic energy from the means for receiving to a circuit board. Coupling the portion of the received electromagnetic energy from the means for receiving to the circuit board includes a means for coupling an electric field and a means for coupling a magnetic field.

In still another aspect, a system is provided that includes means for propagating electromagnetic energy by a waveguide. The system also includes means for receiving at least a portion of the electromagnetic energy from the means for propagating as received electromagnetic energy. Additionally, the system includes means for coupling at least a portion of the received electromagnetic energy from the means for receiving to a circuit board. Coupling the portion of the received electromagnetic energy from the means for receiving to the circuit board includes a means for coupling an electric field and means for coupling a magnetic field.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1A:
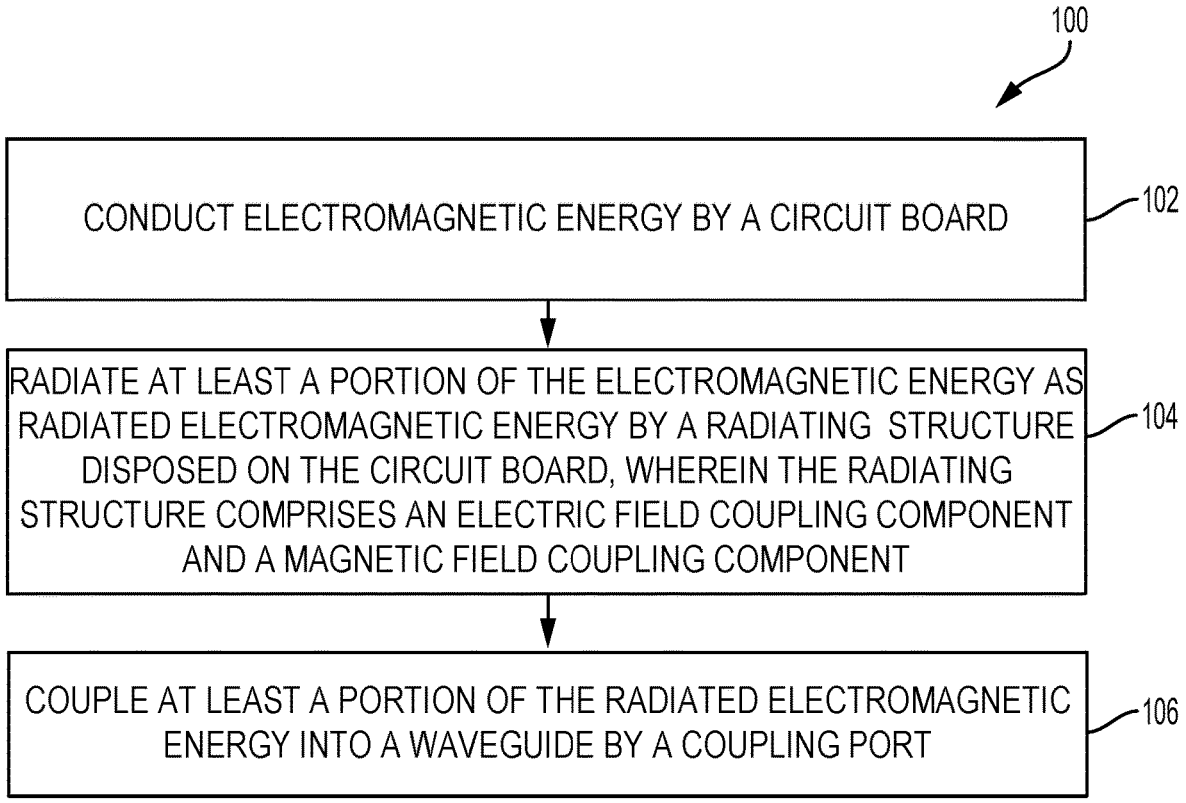
FIG. 1A is a flowchart of an example method to couple electromagnetic energy from a circuit board into a waveguide.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The following detailed description discloses an apparatus including an antenna for a radar system for an autonomous vehicle, for instance, and a method for operating such an antenna. In some examples, the antenna may be a "dual open-ended waveguide" (DOEWG) antenna. The term "DOEWG" can refer to a short section of a horizontal waveguide channel plus a vertical channel that splits into two parts, where each of the two parts of the vertical channel includes an output port configured to radiate at least a portion of electromagnetic waves that enter the antenna. Although the present disclosure generally discusses DOEWG architecture, it may also apply to other antenna and waveguide architectures coupled to a printed circuit board (PCB) structure.

Additionally, the present disclosure is generally described with respect to a RADAR system, however, the present design is not limited to RADAR systems and may be extended to other radio systems. For example, the design can also be used in wireless communication systems such as fifth generation (5G) millimeter-wave (mm-wave) communication and millimeter-wave backhaul designs. Additionally, the presently disclosed design may be used in many different frequency bands, including, but not limited to, 77 GHz automotive RADAR, LMDS Band (28 GHz-31 GHz), V-band 60 GHz, E-band (71-76 GHz/81-86 GHz), and 5G mm-wave (27 GHz-28 GHz and 37 GHz-39 GHz).

An example DOEWG antenna may comprise, for example, two metal layers (e.g., aluminum plates) that can be machined with computer numerical control (CNC), aligned properly, and joined together. The first metal layer may include a first half of an input waveguide channel, where the first half of the first waveguide channel includes an input port that may be configured to receive electromagnetic waves into the first waveguide channel. The first metal layer may also include a first half of a plurality of wave-dividing channels. The plurality of wave-dividing channels may comprise a network of channels that branch out from the input waveguide channel and that may be configured to receive the electromagnetic waves from the input waveguide channel, divide the electromagnetic waves into a plurality of portions of electromagnetic waves (i.e., power dividers), and propagate respective portions of electromagnetic waves to respective wave-radiating channels of a plurality of wave-radiating channels. The DOEWG may also include at least a PCB backplane configured to inject electromagnetic radiation into the waveguide and remove electromagnetic radiation from the waveguide.

Further, the first metal layer may include a first half of the plurality of wave-radiating channels, where respective wave-radiating channels may be configured to receive the respective portions of electromagnetic waves from the wave-dividing channels, and where first halves of the respective wave-radiating channels include at least one wave-directing member configured to propagate sub-portions of electromagnetic waves to another metal layer. The construction here may be known as a split-block construction as a portion of the waveguide is in each of two portions of a waveguide block.

Moreover, the second metal layer may include second halves of the input waveguide channel, the plurality of wave-dividing channels, and the plurality of wave-radiating channels. The second halves of the respective wave-radiating channels may include at least one pair of output ports partially aligned with the at least one wave-directing member and configured to radiate the sub-portions of electromagnetic waves propagated from the at least one wave-directing member out of the second metal layer. More particularly, a combination of a given wave-directing member with a corresponding pair of output ports may take the form of (and may be referred to herein as) a DOEWG, as described above.

While in this particular example the antenna includes multiple wave-dividing channels and multiple wave-radiating channels, in other examples the antenna may include only a single channel configured to propagate all the electromagnetic waves received by the input port to one or more wave-radiating channels. For instance, all the electromagnetic waves may be radiated out of the second metal layer by a single DOEWG. Other examples are possible as well.

Furthermore, while in this particular example, as well as in other examples described herein, the antenna apparatus may be comprised of at least two metal layers, it should be understood that in still other examples, one or more of the channels described above may be formed into a single metal layer, or into more than two metal layers that make up the antenna. Still further, within examples herein, the concept of electromagnetic waves (or portions/sub-portions thereof) propagating from one layer of a DOEWG antenna to another layer is described for the purpose of illustrating functions of certain components of the antenna, such as the wave-directing members. In reality, electromagnetic waves may not be confined to any particular "half" of a channel during certain points of their propagation through the antenna. Rather, at these certain points, the electromagnetic waves may propagate freely through both halves of a given channel when the halves are combined to form the given channel.

In some embodiments discussed herein, the two metal layers may be joined directly, without the use of adhesives, dielectrics, or other materials, and without methods such as soldering, diffusion bonding, etc. that can be used to join two metal layers. For example, the two metal layers may be joined by making the two layers in physical contact without any further means of coupling the layers.

In some examples, the present disclosure includes a radiating structure on the PCB that launches or receives electromagnetic radiation into or from the waveguide. The previously-discussed radiating waveguides may be configured to receive an electromagnetic signal at the radiating waveguide input, propagate the electromagnetic signal down a length of the radiating waveguide, and couple to at least a portion of the electromagnetic signal to at least one radiating structure configured to radiate the coupled electromagnetic signal. Where the PCB and the waveguide have an interface, an electromagnetic wave can transition from propagating along traces of the PCB to propagating in the waveguide (or vice versa). The PCB may include a radiating structure that includes at least one antenna that may transmit an electromagnetic signal into the waveguide or receive an electromagnetic signal from the waveguide.

A radiating structure, such as an antenna, may have reciprocal properties, in that it may function to either transmit or receive signals in a similar manner. Therefore, in this description, properties may be described with respect to transmitting (or receiving). However, the radiating structure may function in a similar manner with respect to both transmitting and receiving. Thus, a radiating structure may not be limited to only transmitting or only receiving.

It may be desirable to have a radiating structure on the PCB that efficiently launches or receives the electromagnetic signal into or from the waveguide. If the efficiency is low, only a small percentage of the electromagnetic energy may couple into or out of the waveguide from the PCB. The remaining electromagnetic energy may not be radiated and may be either reflected or contained within the waveguide or PCB. This electromagnetic energy may produce undesired effects in a radar system. Therefore, it may be desirable to use a high efficiency radiating structure.

In one example, it may also be desirable to have a wide bandwidth of operation for the radiating structure. A wide bandwidth may allow the radiating structure to operate across a wide range of frequencies. In contrast, conventional radiating structures may have a narrow bandwidth of operation. In particular, a conventional radiating structure may efficiently radiate into the waveguide in only a narrow range of frequencies. Thus, a conventional radiating structure may not operate efficiently outside of its narrow bandwidth of operation. By using the presently-disclosed radiating structure, however, the bandwidth of operation may be increased.

The disclosed antenna apparatus may include a coupling port configured to function as a waveguide feed. The waveguide feed may be a coupling port in the metallic structure that enables an electromagnetic wave to enter the antenna apparatus. When the electromagnetic wave enters the antenna apparatus, it may be divided and radiated as previously discussed.

Each coupling port of the antenna apparatus may have an associated port impedance. The port impedance may affect the percentage of the electromagnetic energy that the port can couple into or out of the antenna apparatus. Therefore, it may be desirable to optimize the port impedance and/or an impedance of the radiating structure so energy can efficiently enter or leave the antenna apparatus. There may be several methods by which the port impedance may be optimized. Additionally, the radiating structure may include a geometry or structures to impedance match the radiating structure to the coupling port of the waveguide. For example, the coupling port may be a hole in a waveguide block coupling a circuit board layer to a waveguide layer. By impedance matching, the efficiency of the radiating structure may be increased.

In yet further examples, the coupling port may function as a bidirectional port. It may both provide a feed signal to the waveguide and remove non-radiated electromagnetic energy from the waveguide.

Figure 1B:
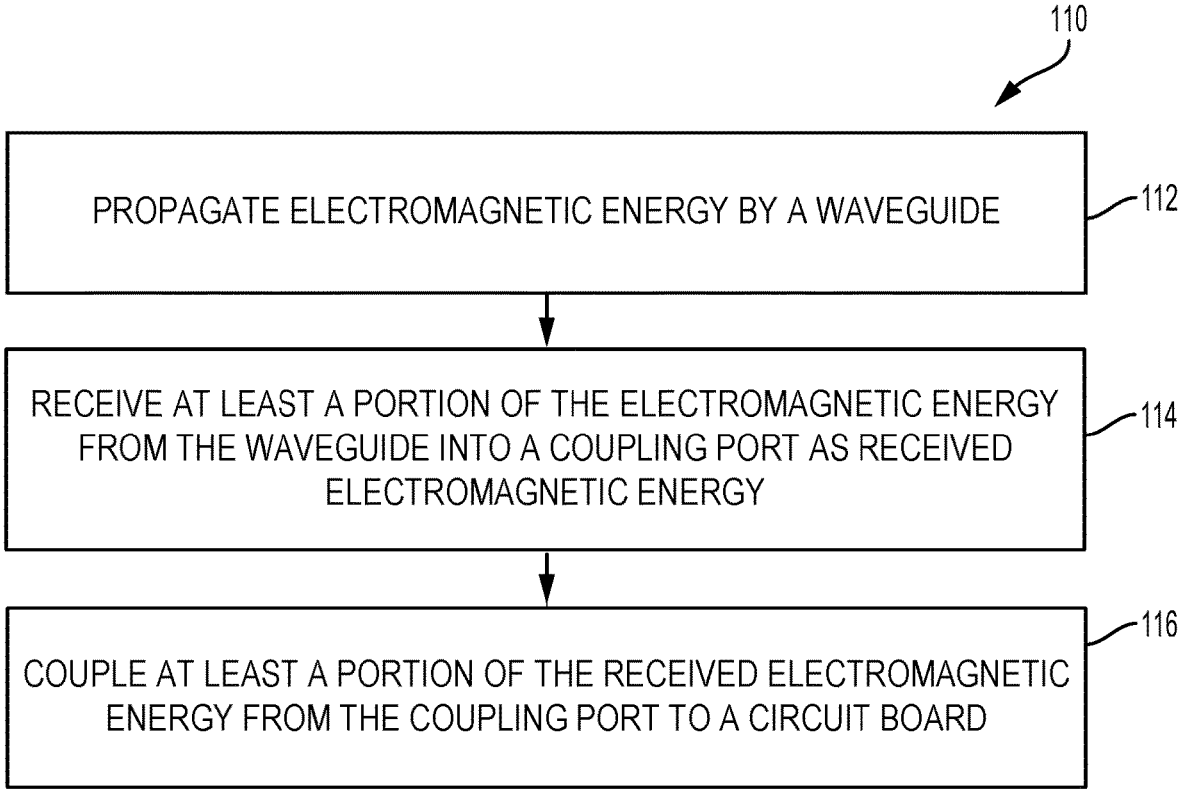
FIG. 1B is a flowchart of an example method to couple electromagnetic energy from a waveguide to a circuit board.

Referring now to the figures, FIG. 1A is a flowchart of an example method 100 to couple electromagnetic energy into a guide. And, FIG. 1B is a flowchart of an example method 110 to couple electromagnetic energy from a guide. It should be understood that other methods of operation not described herein are possible as well.

It should also be understood that a given application of such an antenna may determine appropriate dimensions and sizes for various machined portions of the two metal layers described above (e.g., channel size, metal layer thickness, etc.) and/or for other machined (or non-machined) portions/components of the antenna described herein. For instance, as discussed above, some example radar systems may be configured to operate at an electromagnetic wave frequency of 77 GHz, which corresponds to millimeter electromagnetic wave length. At this frequency, the channels, ports, etc. of an apparatus fabricated by way of method 100 and method 110 may be of given dimensions appropriated for the 77 GHz frequency. Other example antennas and antenna applications are possible as well.

Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

Moreover, the method 100 of FIG. 1A and the method 110 of FIG. 1B may be implemented by the devices described in conjunction with FIGS. 2A-2F, 3A, 3B, and 4A-4D. The method 110 of FIG. 1B may be the reciprocal of method 100 of FIG. 1A. Method 100 of FIG. 1A is directed toward transmitting a signal with the disclosed structures while method 110 is directed toward receiving a signal with the disclosed structures.

In practice, the method 100 may be a method performed during the transmission of radar signals. At block 102, the method 100 includes conducting electromagnetic energy (e.g., 77 GHz millimeter electromagnetic waves) by a circuit board. In various examples, the electromagnetic energy may propagate in at least one of several different modes depending on the various embodiments. In one example, the electromagnetic energy may propagate along a differential pair of lines on the circuit board. In another example, the electromagnetic energy may propagate along a single line on the circuit board. The electromagnetic energy may be a signal for transmission by an antenna and/or a radar unit. In various examples, different types of signaling may be used to form the electromagnetic energy. In practice, the method 100 may be a method performed during the transmission of radar signals.

At block 104, the method 100 includes radiating at least a portion of the electromagnetic energy as radiated electromagnetic energy by a radiating structure disposed on the circuit board, wherein the radiating structure comprises an electric field coupling component and a magnetic field coupling component. The circuit board may have at least one component that radiates electromagnetic energy. In some examples, this radiating component may be functionally similar to a circuit-board-mounted patch antenna. Various other types of components may be used to radiate electromagnetic energy from the circuit board as well. Various antennas, patches, slots, or other radiating components may be used within the context of the present disclosure as well. The radiating component may also function as a component that may receive electromagnetic energy from the coupling port (i.e., the component may function in a bidirectional manner).

The radiating component is configured to convert at least a portion of the electromagnetic energy propagating on the circuit board into radiated electromagnetic energy (i.e., electromagnetic energy that is not contained on a metallic trace of or within the circuit board). In some examples, an electromagnetic signal may propagate down one or more traces of the circuit board. When the electromagnetic signal propagates to the radiating component, the radiating component may radiate all or a portion of the electromagnetic signal as an electromagnetic signal away from the radiating component.

In a traditional circuit board to waveguide transition, a radiating component may include a square and/or rectangular patch configured to radiate electromagnetic energy from the circuit board into the coupling port of the waveguide. However, a patch antenna may have a limited bandwidth of use. Additionally, a patch antenna may also have an impedance that may not match well to an impedance of the coupling port.

The presently disclosed apparatus includes a radiating structure that includes both an electric field coupling component and a magnetic field coupling component. Although the electric field and magnetic field coupling components may be described as separate components, in some examples they may be different portions of a single radiating unit. Additionally, the electric field and magnetic field coupling components may be described as coupling a respective electric field or magnetic field, however, each component may couple both an electric and a magnetic field.

The terms electric field radiating component and magnetic field radiating component describe the near-field properties and method of field radiation. For example, an electric field radiating component may primarily excite an electric field in the near-field of the component. In the far field, this electric field may induce a propagating electromagnetic wave (i.e., both an electric and magnetic field). Similarly, a magnetic field radiating component may primarily excite a magnetic field in the near-field of the component. As with the electric field radiating component, in the far field, the magnetic field may induce a propagating electromagnetic wave (i.e., both an electric and magnetic field).

In some examples, the electric field coupling component may take the form of a patch. The patch may take the shape of a square, rectangle, and/or modified square or rectangle. The patch may be coupled to trace lines that propagate an electromagnetic signal on the circuit board. The electric field coupling component may couple an electric field from the circuit board into the coupling port of the waveguide unit. For example, the electric field coupling component may induce a near-field electric field that causes far-field electromagnetic propagation. A dipole antenna is one example of an electric field coupling component. A magnetic field coupling component may couple a magnetic field from the circuit board into the coupling port. For example, the magnetic field coupling component may induce a near-field magnetic field that causes far-field electromagnetic propagation. A loop antenna is one example of a magnetic field coupling component.

The magnetic field coupling component may increase the bandwidth and efficiency of the electric field coupling component. In some examples, the magnetic field coupling component may be physically connected to the electric field coupling component and/or the trace that feeds the electromagnetic signal. In other examples, magnetic field coupling component may be physically separated from the electric field coupling component and/or the trace that feeds the electromagnetic signal. In examples where the magnetic field coupling component is separated from the electric field coupling component and the trace, the magnetic field coupling component may couple to a portion of an electromagnetic signal that is radiated by the electric field coupling component and reradiate it.

As previously stated, the magnetic field coupling component may take the form of a loop antenna. The loop may be metal traces on the circuit board. As previously discussed, the loop may be either coupled to the electric field coupling component or separate from the electric field coupling component. The loop may cause a near-field magnetic field that launches electromagnetic radiation into a coupling port.

At block 106, the method 100 includes coupling at least a portion of the radiated electromagnetic energy into a waveguide by a coupling port. The coupling port may be a passage between the waveguide and the circuit board. The passage allows electromagnetic energy from the circuit board to enter the waveguide. In some examples, the coupling port may have dimensions based on a desired impedance of the port. The impedance of the port may, in part, contribute to the percentage of the electromagnetic energy from the circuit board that couples into the waveguide. Because the port impedance may affect the percentage of the electromagnetic energy that the port can couple into or out of the antenna apparatus, it may be desirable to either (i) optimize the port impedance so energy can efficiently enter or leave the antenna apparatus or (ii) design the radiating component of the circuit board to optimize energy transfer. The optimizations of the port impedance may be controlled by adjusting the port dimensions.

In some examples, the circuit board may be coupled to the block that forms the antenna (e.g., radar) unit of the present system. For example, and as discussed with respect to the following figures, the system may be constructed in a block. The waveguide and associated beamforming network may be created on a plane of the block. In various examples, the circuit board may be mounted on the bottom of the bottom block and the coupling port may be through the bottom of the bottom block. In another example, the circuit board may be mounted to a side of the block. In this example, the coupling port may be through the side of one of or both of the top block and bottom block.

Turning to FIG. 1B, at block 112, method 110 includes propagating electromagnetic energy by a waveguide. The electromagnetic energy in the waveguide may have been received from outside of the system by at least one antenna of the waveguide. In practice, the method 110 may be a method performed during the reception of radar signals. The antenna(s) coupled to the waveguide may receive electromagnetic energy and propagate the electromagnetic energy along the waveguide.

At block 114, the method 110 includes receiving at least a portion of the radiated electromagnetic energy from the waveguide by a coupling port as received electromagnetic energy. As previously discussed, the coupling port may be a passage between the waveguide and the circuit board. As part of method 110, the passage allows electromagnetic energy from the waveguide to leave the waveguide and couple to a component of the circuit board.

The coupling port of method 110 may function in a similar manner to the coupling port of method 100, but operating in the opposite direction (e.g., method 100 causes electromagnetic energy to enter the guide from the circuit board while method 110 causes electromagnetic energy to leave the guide to the circuit board). Similar to method 100, the coupling port of method 110 may have dimensions based on a desired impedance of the port. The impedance of the port may, in part, contribute to the percentage of the electromagnetic energy from the circuit board that couples into the waveguide. Because the port impedance may affect the percentage of the electromagnetic energy that the port can couple into or out of the antenna apparatus, it may be desirable to either (i) optimize the port impedance so energy can efficiently enter or leave the antenna apparatus or (ii) design the radiating component of the circuit board to optimize energy transfer. The optimizations of the port impedance may be controlled by adjusting the port dimensions.

At block 116, the method 110 includes coupling at least a portion of the received electromagnetic energy from the coupling port to a circuit board by a coupling component of the circuit board where coupling the portion of the radiated electromagnetic energy into the waveguide via the coupling port includes coupling an electric field from the circuit board into the coupling port by the electric field coupling component and coupling a magnetic field from the circuit board into the coupling port by the magnetic field coupling component. The circuit board may have a radiating component that receives electromagnetic energy. The radiating component described with respect to block 116 may be similar to the radiating component described with respect to block 104. However, the radiating component of block 116 may function to couple electromagnetic signals from the coupling port to the circuit board. The radiating component may also function as a component that may radiate electromagnetic energy into the coupling port (i.e., the component may function in a bidirectional manner). As previously described, the radiating component includes both electric field and magnetic field radiating components.

The arrangement of the components of FIGS. 2A-F are shown as example systems and arrangements in which the present disclosure may be used. Other shapes, alignments, positions, styles, and other arrangements of waveguides and antennas may be used with the PCB transition coupling port disclosed herein.

FIGS. 2A through 2F present one example layout for waveguides. The examples shown in FIGS. 2A through 2F are meant to display one particular arrangement with which the disclosed broadband waveguide launch design may be used.

Figure 2A:
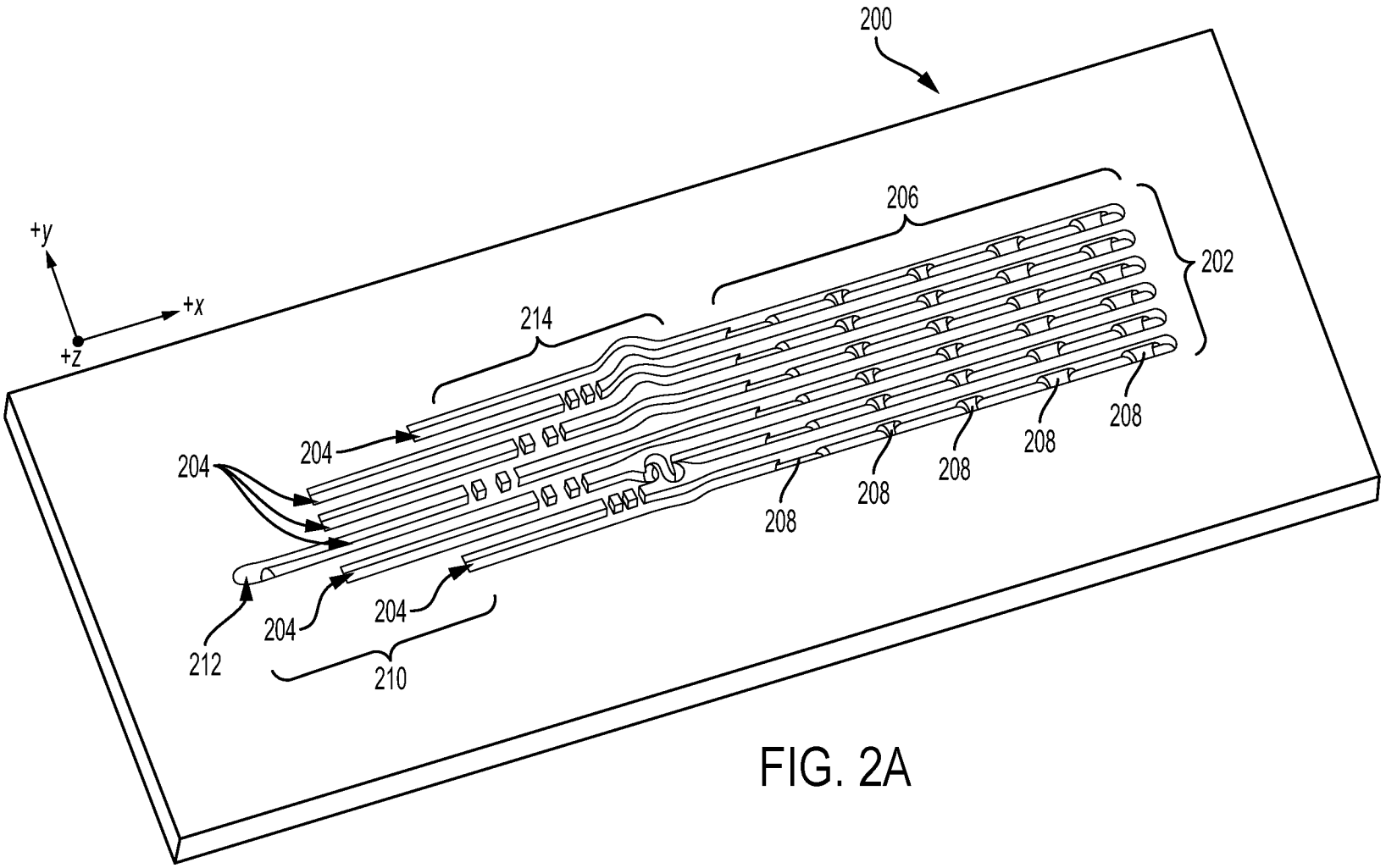
FIG. 2A illustrates a first layer of an example antenna, in accordance with an example embodiment.

FIG. 2A illustrates an example first metal layer 200 including a first half of a plurality of waveguide channels 202. These waveguide channels 202 may comprise multiple elongated segments 204. At a first end 206 of each elongated segment 204 may be a plurality of collinear wave-directing members 208, each with sizes similar or different from other wave-directing members. In line with the description above, the first ends 206 of the elongated segments 204 may be referred to herein as a first half of wave-radiating channels.

At a second end 210 of the channels 202 opposite the first end 206, one of the elongated segments 204 may include a through-hole 212 (i.e., coupling port). A given amount of power may be used to feed a corresponding amount of electromagnetic waves (i.e., energy) into the apparatus, and the through-hole 212 may be the location where these waves are fed into the apparatus. In line with the description above, the single channel/segment of the waveguide channels 202 that includes the input port may be referred to herein as an input waveguide channel. Further, the second end 210 of the channels 202 may be coupled to an attenuation component (not shown here).

Upon entering the apparatus, the electromagnetic waves may generally travel in the +x direction, as shown, towards an array of power dividers 214 (e.g., a "beam-forming network"). The array 214 may function to divide up the electromagnetic waves and propagate respective portions of the waves to respective first ends 206 of each elongated segment 204. More specifically, the waves may continue to propagate in the +x direction after leaving the array 214 toward the wave-directing members 208. In line with the description above, the array 214 section of the waveguide channels may be referred to herein as wave-dividing channels.

As the portions of the electromagnetic waves reach the wave-directing members 208 at the first end 206 of each elongated segment 204 of the waveguide channels 202, the wave-directing members 208 may propagate through respective sub-portions of the electromagnetic energy to a second half of the waveguide channels (e.g., in the +z direction, as shown). For instance, the electromagnetic energy may first reach a wave-directing member that is recessed, or machined further into the first metal layer 200 (e.g., a pocket). That recessed member may be configured to propagate a smaller fraction of the electromagnetic energy than each of the subsequent members further down the first end 206, which may be protruding members rather than recessed members.

Further, each subsequent member may be configured to propagate a greater fraction of the electromagnetic waves travelling down that particular elongated segment 204 at the first end 206 than the member that came before it. As such, the member at the far end of the first end 206 may be configured to propagate the highest fraction of electromagnetic waves. Each wave-directing member 208 may take various shapes with various dimensions. In other examples, more than one member (or no members) may be recessed. Still other examples are possible as well. In addition, varying quantities of elongated segments are possible.

A second metal layer may contain a second half of the one or more waveguide channels, where respective portions of the second half of the one or more waveguide channels include an elongated segment substantially aligned with the elongated segment of the first half of the one or more waveguide channels and, at an end of the elongated segment, at least one pair of through-holes partially aligned with the at least one wave-directing member and configured to radiate electromagnetic waves propagated from the at least one wave-directing member out of the second metal layer.

Within examples, the elongated segment of the second half may be considered to substantially align with the elongated segment of the first half when the two segments are within a threshold distance, or when centers of the segments are within a threshold distance. For instance, if the centers of the two segments are within about ±0.051 mm of each other, the segment may be considered to be substantially aligned.

In another example, when the two halves are combined (i.e., when the two metal layers are joined together), edges of the segments may be considered to be substantially aligned if an edge of the first half of a segment and a corresponding edge of the second half of the segment are within about ±0.051 mm of each other.

In still other examples, when joining the two metal layers, one layer may be angled with respect to the other layer such that their sides are not flush with one another. In such other examples, the two metal layers, and thus the two halves of the segments, may be considered to be substantially aligned when this angle offset is less than about 0.5 degrees.

In some embodiments, the at least one pair of through-holes may be perpendicular to the elongated segments of the second half of the one or more waveguide channels. Further, respective pairs of the at least one pair of through-holes may include a first portion and a second portion. As such, a given pair of through-holes may meet at the first portion to form a single channel. That single channel may be configured to receive at least the portion of electromagnetic waves that was propagated by a corresponding wave-directing member and propagate at least a portion of electromagnetic waves to the second portion. Still further, the second portion may include two output ports configured as a doublet and may be configured to receive at least the portion of electromagnetic waves from the first portion of the pair of through-holes and propagate at least that portion of electromagnetic waves out of the two output ports.

Figure 2B:
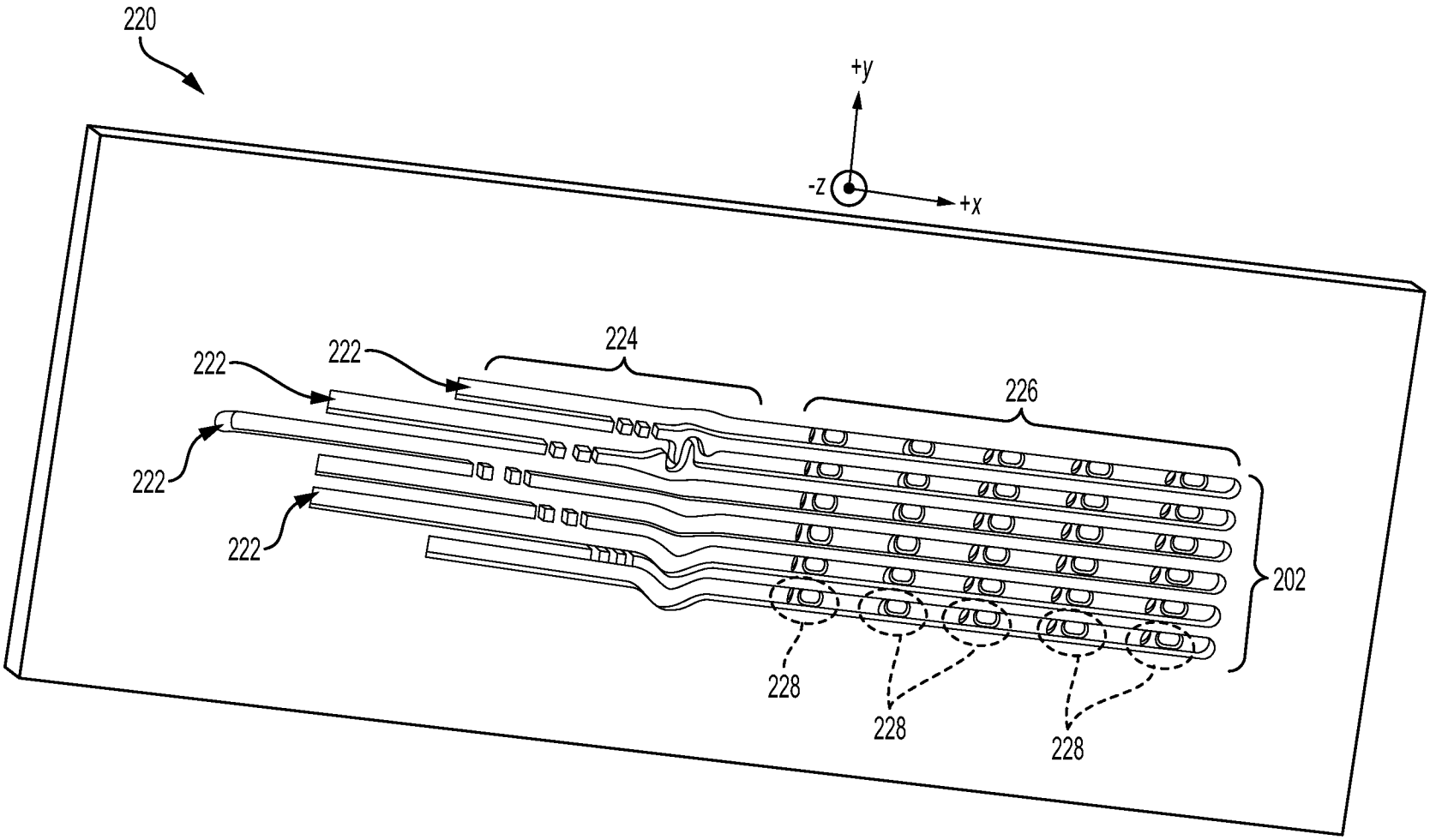
FIG. 2B illustrates a second layer of an example antenna, in accordance with an example embodiment.

FIG. 2B illustrates the second metal layer 220 described above. The second metal layer 220 may include a second half of the plurality of waveguide channels 202 of the first metal layer 200 shown in FIG. 2A (i.e., a second half of the input waveguide channel, the wave-dividing channels, and the wave-radiating channels). As shown, the second half of the waveguide channels 202 may take on the general form of the first half of the channels, so as to facilitate proper alignment of the two halves of the channels. The elongated segments of the second half 222 may include second halves of the array of power dividers 224. As described above, electromagnetic waves may travel through the array 224, where they are divided into portions, and the portions then travel (i.e., in the +x direction, as shown) to respective ends 226 of the second halves of the elongated segments 222.

Further, an end 226 of a given elongated segment may include multiple pairs of through-holes 228, which may be at least partially aligned with the wave-directing members 208 of the first metal layer 200. More specifically, each pair of through-holes may be at least partially aligned with a corresponding wave-directing member, also referred to as a reflecting element, such that when a given sub-portion of electromagnetic waves are propagated from the first metal layer 200 to the second metal layer 220, as described above, those sub-portions are then radiated out of the pair of through-holes (e.g., a pair of output ports) in the −z direction, as shown. Again, the combination of a given wave-directing member and a corresponding pair of output ports may form a DOEWG, as described above.

Moreover, a combination of all the DOEWGs may be referred to herein as a DOEWG array. In antenna theory, when an antenna has a larger radiating aperture (e.g., how much surface area of the antenna radiates, where the surface area includes the DOEWG array) that antenna may have higher gain (dB) and a narrower beam width. As such, in some embodiments, a higher-gain antenna may include more channels (e.g., elongated segments), with more DOEWGs per channel. While the example antenna illustrated in FIGS. 2A and 2B may be suitable for autonomous-vehicle purposes (e.g., six elongated segments, with five DOEWGs per segment), other embodiments may be possible as well, and such other embodiments may be designed/machined for various applications, including, but not limited to, automotive radar.

For instance, in such other embodiments, an antenna may include a minimum of a single DOEWG. With this arrangement, the output ports may radiate energy in all directions (e.g., low gain, wide beam width). Generally, an upper limit of segments/DOEWGs may be determined by a type of metal used for the first and second metal layers. For example, metal that has a high resistance may attenuate an electromagnetic wave as that wave travels down a waveguide channel. As such, when a larger, highly-resistive antenna is designed (e.g., more channels, more segments, more DOEWGs, etc.), energy that is injected into the antenna via the input port may be attenuated to an extent where not much energy is radiated out of the antenna. Therefore, in order to design a larger antenna, less resistive (and more conductive) metals may be used for the first and second metal layers. For instance, in embodiments described herein, at least one of the first and second metal layers may be aluminum. Further, in other embodiments, at least one of the first and second metal layers may be copper, silver, or another conductive material. Further, aluminum metal layers may be plated with copper, silver, or other low-resistance/high-conductivity materials to increase antenna performance. Other examples are possible as well.

The antenna may include at least one fastener configured to join the first metal layer to the second metal layer so as to align the first half of the one or more waveguide channels with the second half of the one or more waveguide channels to form the one or more waveguide channels (e.g., align the first half of the plurality of wave-dividing channels of the split block with the second half of the plurality of wave-dividing channels of the split block, and align the first half of the plurality of wave-radiating channels with the second half of the plurality of wave-radiating channels). To facilitate this in some embodiments, the first metal layer, a first plurality of through-holes (not shown in FIG. 2A) may be configured to house the at least one fastener. Additionally, in the second metal layer, a second plurality of through-holes (not shown in FIG. 2B) may be substantially aligned with the first plurality of through-holes and configured to house the at least one fastener for joining the second metal layer to the first metal layer. In such embodiments, the at least one fastener may be provided into the aligned first and second pluralities of through-holes and secured in a manner such that the two metal layers are joined together.

In some examples, the at least one fastener may be multiple fasteners. Mechanical fasteners (and technology used to facilitate fastening) such as screws and alignment pins may be used to join the two metal layers together. Further, in some examples, the two metal layers may be joined directly to each other, with no adhesive layer in between. Still further, the two metal layers may be joined together using methods different than adhesion, diffusion bonding, soldering, brazing, and the like. However, it is possible that, in other examples, such methods may be used in addition to or alternative to any methods for joining metal layers that are known or not yet known.

In some embodiments, one or more blind-holes may be formed into the first metal layer and/or into the second metal layer in addition to or alternative to the plurality of through-holes of the first and/or the second metal layer. In such embodiments, the one or more blind-holes may be used for fastening (e.g., housing screws or alignment pins) or may be used for other purposes.

Figure 2C:
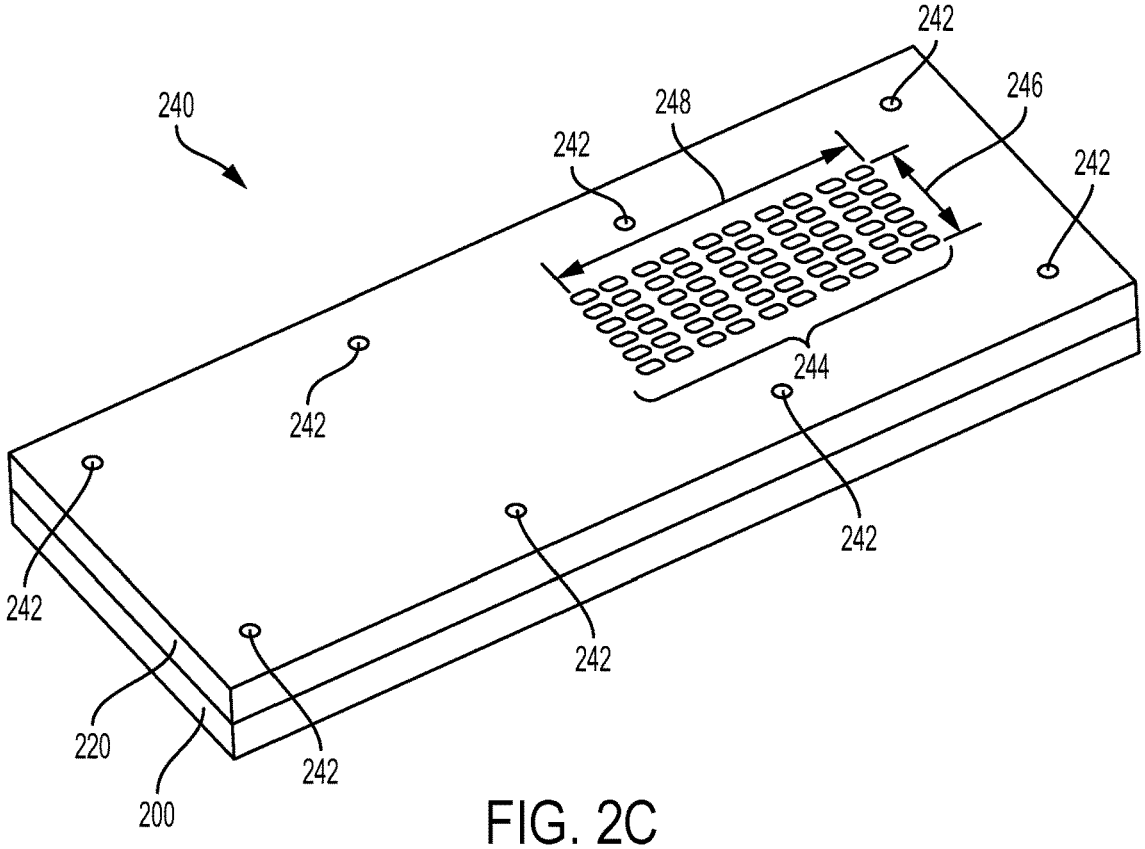
FIG. 2C illustrates an assembled view of an example antenna, in accordance with an example embodiment.

FIG. 2C illustrates an assembled view of an example antenna 240. The example antenna 240 may include the first metal layer 200 and the second metal layer 220. The second metal layer 220 may include a plurality of holes 242 (through-holes and/or blind-holes) configured to house alignment pins, screws, and the like. The first metal layer 200 may include a plurality of holes as well (not shown) that are aligned with the holes 242 of the second metal layer 220.

Further, FIG. 2C illustrates a DOEWG array 244 of a given width 246 and a given length 248, which may vary based on the number of DOEWGs and channels of the antenna 240. For instance, in an example embodiment, the DOEWG array may have a width of about 11.43 mm and a length of about 28.24 mm. Further, in such an example embodiment, these dimensions, in addition to or alternative to other dimensions of the example antenna 240, may be machined with a tolerance that may allow up to about a 0.51 mm error, though in other embodiments, more or less of an error may be required. Other dimensions of the DOEWG array are possible as well. Further, in some examples, other shaped outputs may be used for the radiating structures. Although shown as ovals in FIG. 2C, the radiating structures can take any shape and the shape is not critical to the present disclosure. In some examples, the radiating structures may be square, circular, linear, z-shaped, etc.

In some embodiments, the first and second metal layers 200, 220 may be machined from aluminum plates (e.g., about 6.35 mm stock). In such embodiments, the first metal layer 200 may be at least 3 mm in thickness (e.g., about 5.84 mm to 6.86 mm). Further, the second metal layer 220 may be machined from a 6.35 mm stock to a thickness of about 3.886 mm. Other thicknesses are possible as well.

In some embodiments, the joining of the two metal layers 200, 220 may result in an air gap or other discontinuity between mating surfaces of the two layers. In such embodiments, this gap or continuity can be proximate to (or perhaps as close as possible to) a center of the length of the antenna apparatus and may have a size of about 0.05 mm or smaller.

Figure 2D:
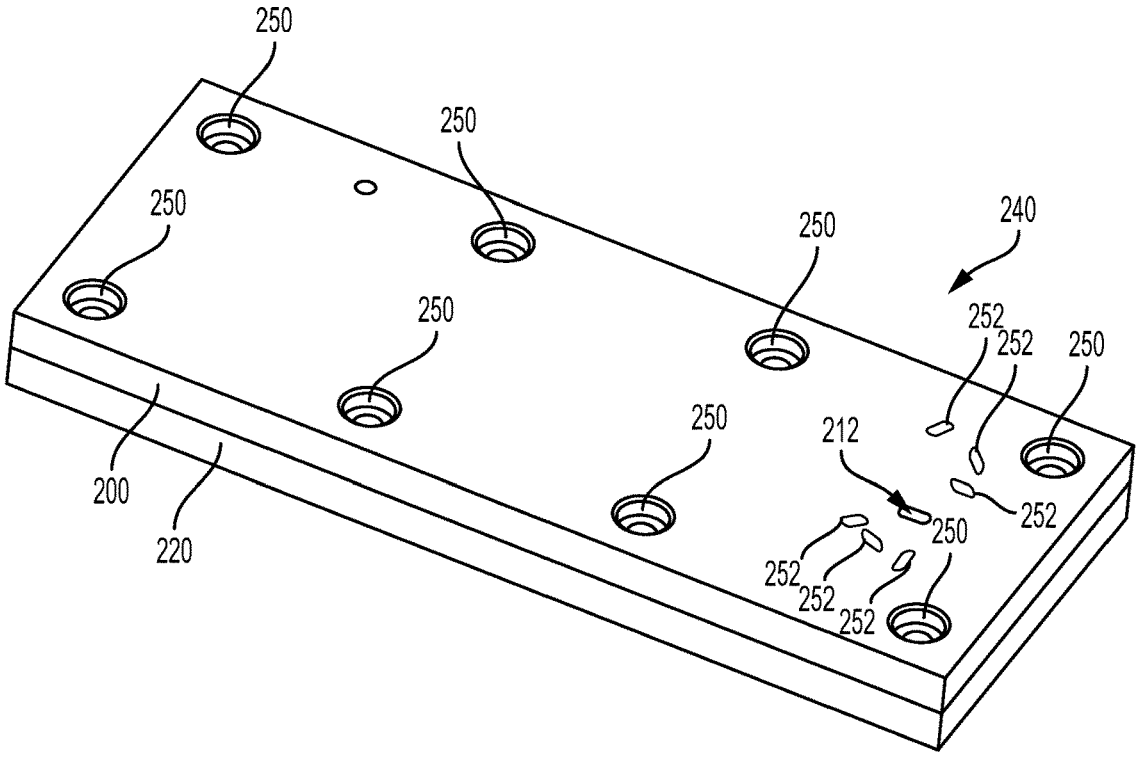
FIG. 2D illustrates an assembled view of an example antenna, in accordance with an example embodiment.

FIG. 2D illustrates another assembled view of the example antenna 240. As shown, the first metal layer 200 may include a plurality of holes 250 (through-holes and/or blind-holes) configured to house alignment pins, screws, and the like. One or more of the plurality of holes 250 may be aligned with the holes 242 of the second metal layer 220. Further, FIG. 2D shows an input coupling port 212, where the antenna 240 may receive electromagnetic waves into the one or more waveguide channels 202. In addition, FIG. 2D features multiple coupling ports 252. The coupling ports 252 may couple from waveguides within the first metal layer 200 to components on a PCB (not shown in FIG. 2D) that couple electromagnetic energy from the respective coupling port. The coupling ports 212, 252 may take the form of coupling port 404 of FIG. 4A.

Figure 2E:
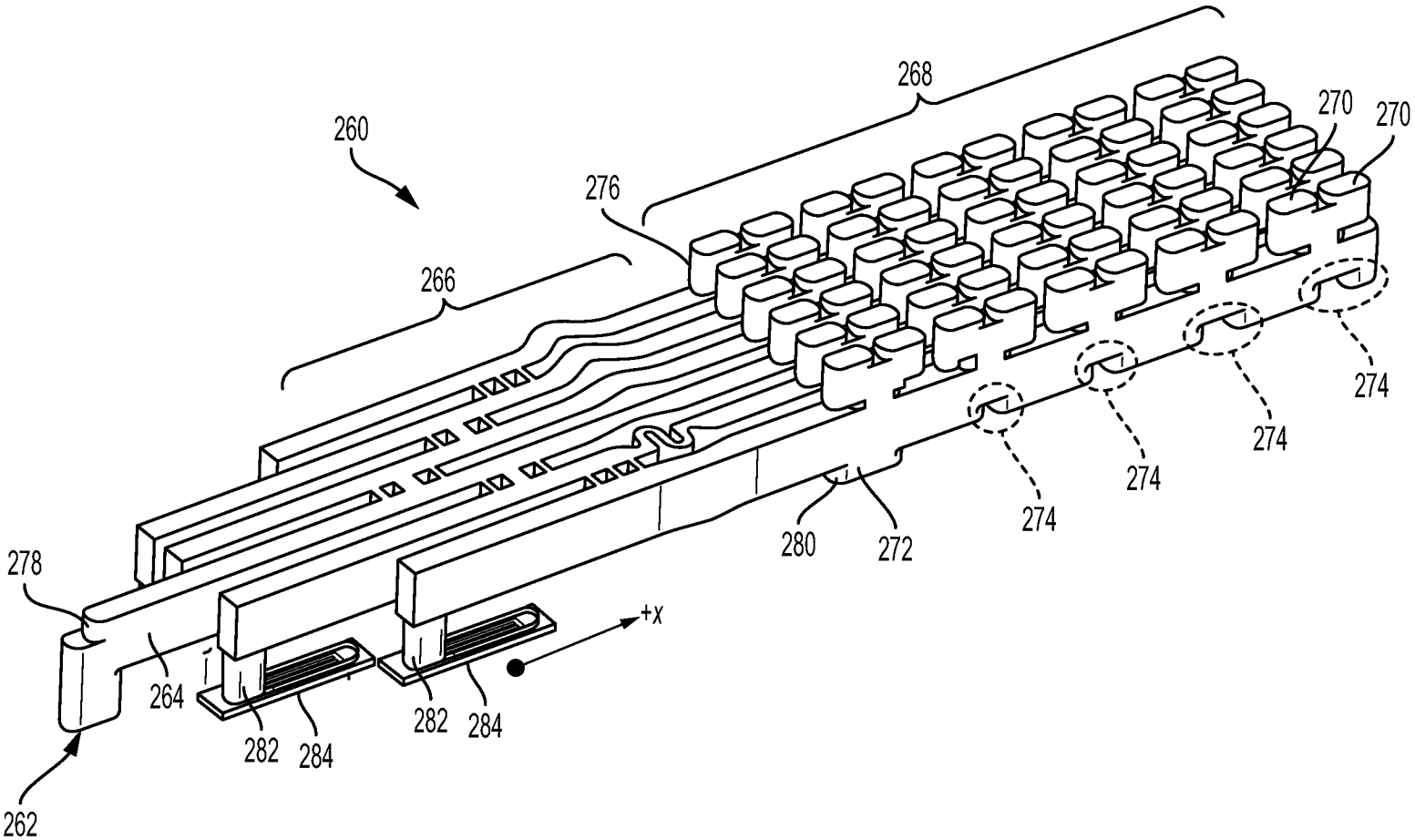
FIG. 2E illustrates conceptual waveguide channels formed inside an assembled example antenna, in accordance with an example embodiment.

FIG. 2E illustrates conceptual waveguide channels 260 formed inside an assembled example antenna. More particularly, the waveguide channels 260 take the form of the waveguide channels 202 of FIGS. 2A and 2B. For instance, the channels 260 include an input port 262 to the input waveguide channel 264. The channels 260 also include wave-dividing channels 266 and a plurality of radiating doublets 268 (e.g., a DOEWG array). As described above, when electromagnetic waves enter the channels 260 at the input coupling port 262, they may travel in the +x direction through the input waveguide channel 264 and be divided into portions by the wave-dividing channels 266 (e.g., by the power dividers). Those portions of electromagnetic waves may then travel in the +x direction to respective radiating doublets 268, where sub-portions of those portions are radiated out each DOEWG through pairs of output ports, such as pair 270, for instance.

In a particular wave-radiating channel, a portion of electromagnetic waves may first be propagated through a first DOEWG with a recessed wave-directing member 272 (e.g., an inverse step, or "well"), as discussed above. This recessed wave-directing member 272 may be configured to radiate the smallest fraction of energy of all the members of the DOEWGs of the particular wave-radiating channel. In some examples, subsequent wave-directing members 274 may be formed (e.g., protruded, rather than recessed) such that each subsequent DOEWG can radiate a higher fraction of the remaining energy than the DOEWG that came before it. Phrased another way, each wave-directing member 272, 274 may generally be formed as a "step cut" into a horizontal (+x direction) channel (e.g., a wave-radiating channel, or the "first end" of an "elongated segment" as noted above) and used by the antenna to tune the amount of energy that is radiated vs. the amount of energy that is transmitted further down the antenna.

In some embodiments, a given DOEWG may not be able to radiate more than a threshold level of energy and may not be able to radiate less than a threshold level of energy. These thresholds may vary based on the dimensions of the DOEWG components (e.g., the wave-directing member, a horizontal channel, a vertical channel, a bridge between the two output ports, etc.), or may vary based on other factors associated with the antenna.

In some embodiments, the first and second metal layers may be machined such that various sides of the waveguide channels 260 have rounded edges, such as edge 276, 278, and 280, for example.

Further shown in FIG. 2E are both coupling ports 282 and PCB-based coupling components 284. The PCB-based coupling components 284 may be coupled to the coupling ports 282. And the coupling ports 282 may be coupled to the elongated segments 222 of the wave-dividing channels 266. The design of the PCB-based coupling components 284 and coupling ports 282 are discussed further with respect to FIGS. 4A through 4D.

Figure 3A:
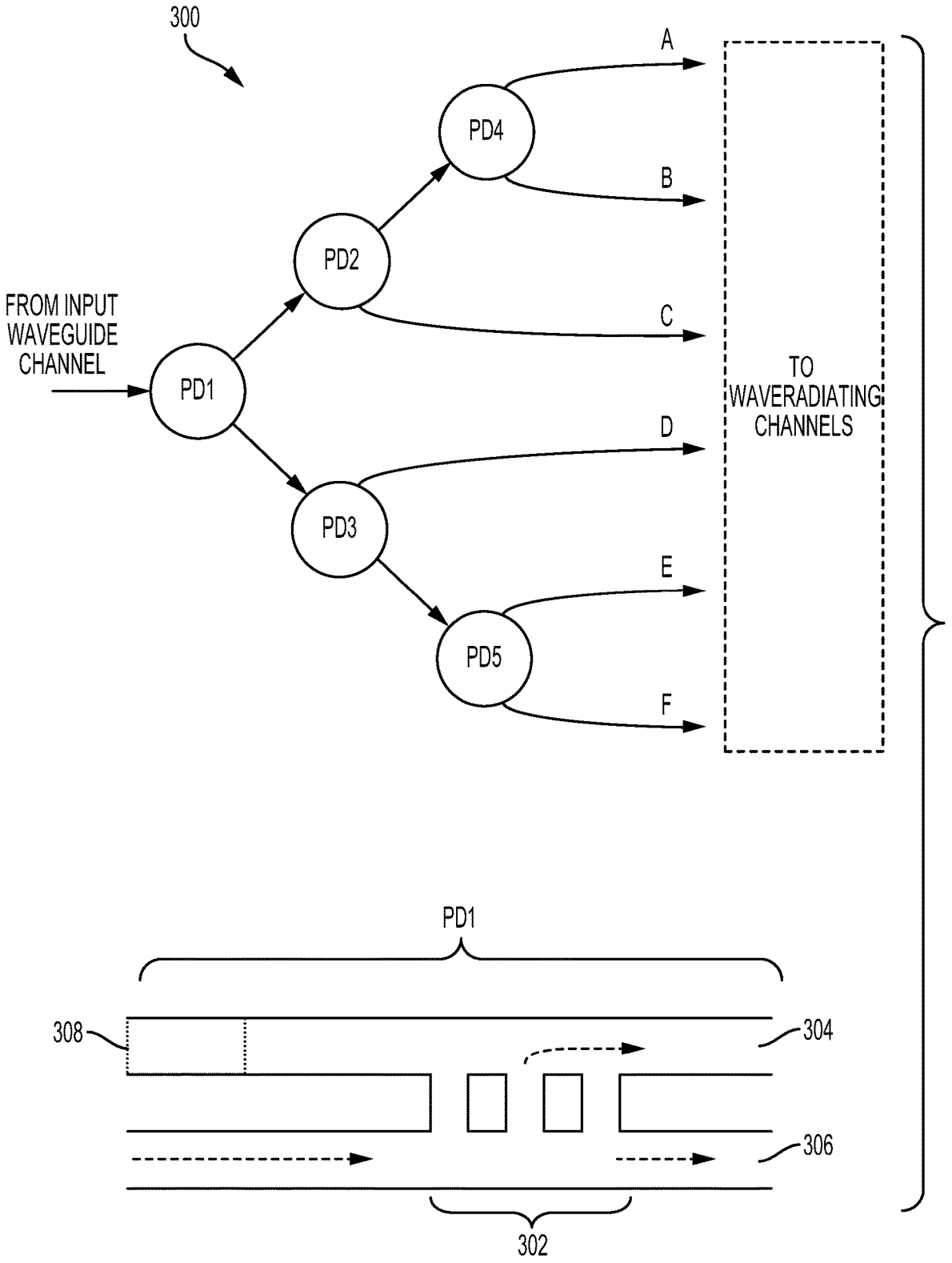
FIG. 3A illustrates a network of wave-dividing channels of an example antenna, in accordance with an example embodiment.
Figure 3B:
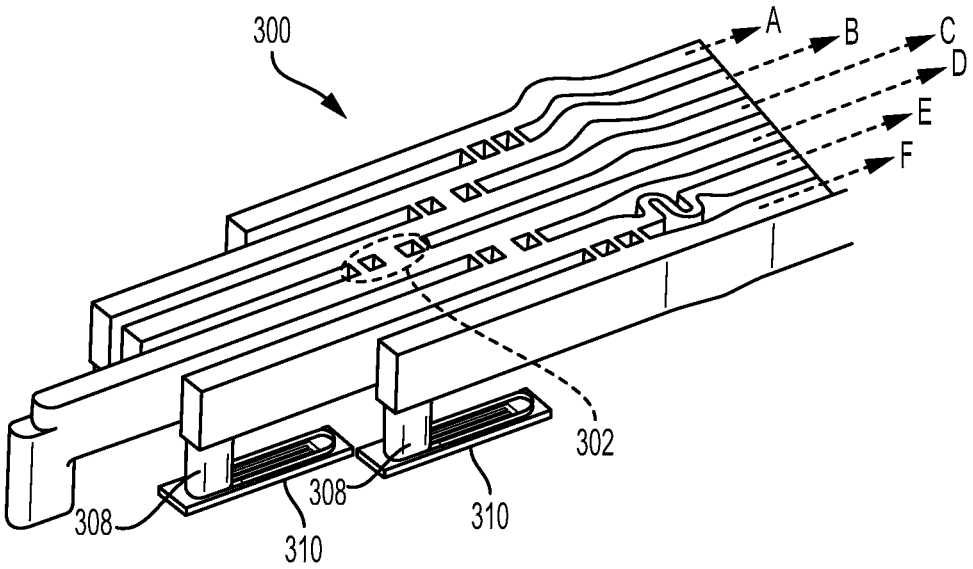
FIG. 3B illustrates an alternate view of the network of wave-dividing channels of FIG. 3A, in accordance with an example embodiment.

FIG. 3A illustrates a network of wave-dividing channels 300 of an example antenna, in accordance with an example embodiment. FIG. 3B illustrates an alternate view of the network of wave-dividing channels 300, in accordance with an example embodiment.

In some embodiments, the network (e.g., beam-forming network, as noted above) of wave-dividing channels 300 may take the form of a tree of power dividers, as shown in FIG. 3A. Energy may enter the antenna through the input waveguide channel and is divided (i.e., split) into smaller portions of energy at each power divider, such as power divider 302, and may be divided multiple times via subsequent power dividers so that a respective amount of energy is fed into each of the wave-radiating channels (energy A-F, as shown). The amount of energy that is divided at a given power divider may be controlled by a power division ratio (i.e., how much energy goes into one channel 304 versus how much energy goes into another channel 306 after the division). A given power division ratio may be adjusted based on the dimensions of the corresponding power divider.

Within examples, a technique for dividing energy between two channels 304, 306 may be to use a structure of channels (e.g., a "four-port branchline coupler") such as that shown at the bottom of FIG. 3A. Such a technique and structure design may include feeds 310 and coupling ports 308 at the end of a channel, as shown in FIGS. 3A and 3B, where each of the coupling ports 308 is configured to couple energy that returns backwards through the channel to one of the feeds 310. The feeds 310 may be configured to absorb the returned energy. The design of the feeds 310 and coupling ports 308 are discussed further with respect to FIG. 4B.

FIGS. 4A through 4D shows various example embodiments of the disclosed apparatuses. The disclosed broadband waveguide launch designs on single layer PCB may utilize a feed that couples a signal from a trace of the PCB to a radiating component. In some examples, the trace is physically connected to the radiating component. In other examples, the trace may induce a field in the radiating component while not making physical contact.

In some examples, the radiating component may be designed to launch a wave in a mode corresponding to the type of waveguide in which the wave will be launched. For example, for a rectangular waveguide it may be desirable to excite a $TE_{10}$ mode and for a circular waveguide it may be desirable to excite a $TE_{11}$ mode. Additionally, to enable highly integrated electronic modules, it may be desirable to design a radiating structure that utilizes the least amount of area as well as the minimum number of metal layers of the PCB.

The proposed design in this disclosure utilizes a single metal layer design for the PCB while also that achieving greater than 10% bandwidth. A traditional patch antenna feed would have approximately 5% bandwidth. In one example, the novelty of the design is the complementary excitations of electrical and magnetic fields by the radiating structure on the PCB. Previous design techniques that try to achieve similar bandwidth conventionally require two pieces of waveguide with quarter wavelength back shorted waveguide, or require multiple layer PCB designs such as the proximity patch launch or the aperture patch launch. This design achieves a high bandwidth on a single-layer PCB by using the dual excitation radiating structure.

Figure 4A:
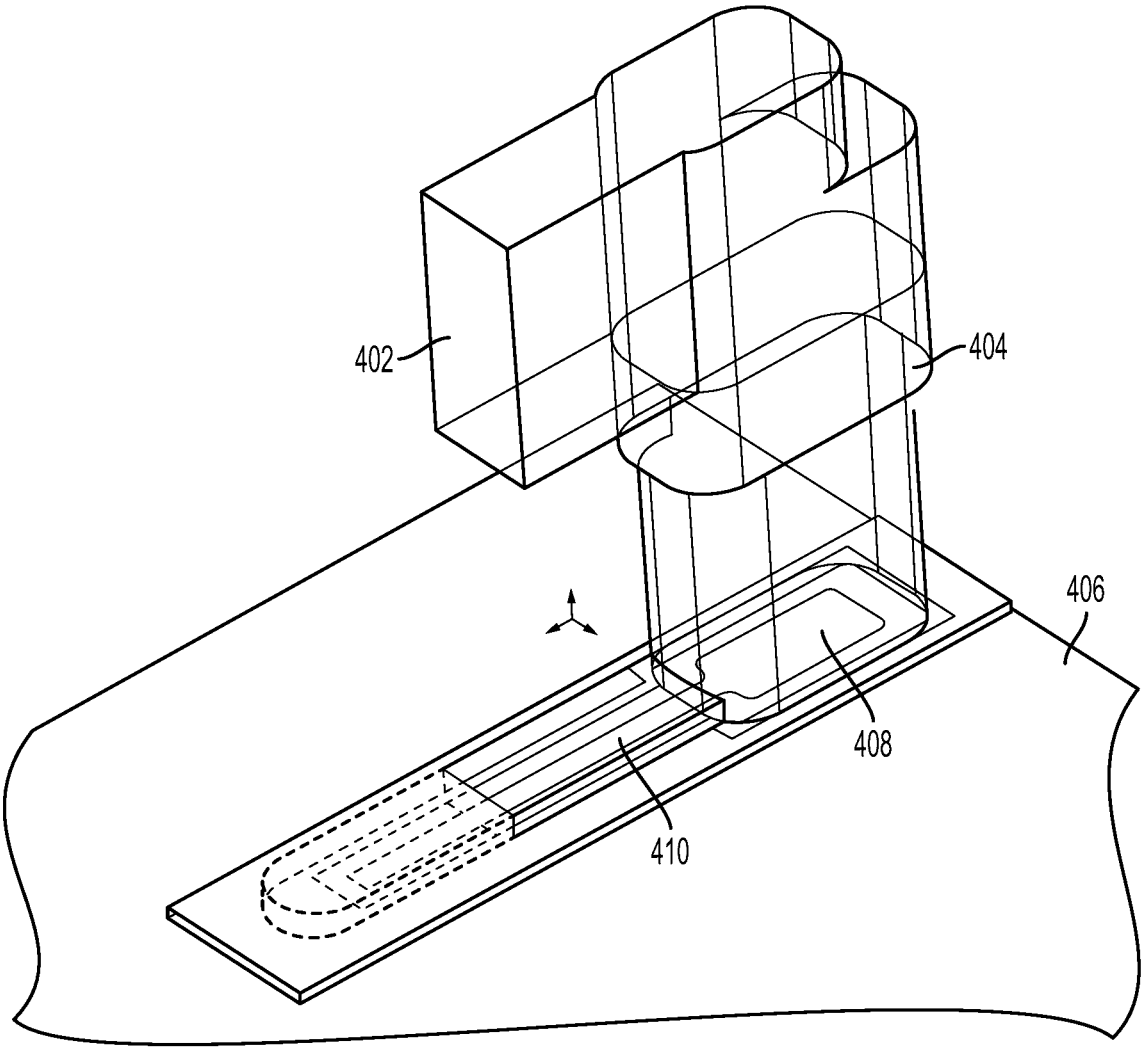
FIG. 4A illustrates an example PCB to waveguide transition.

FIG. 4A illustrates an example waveguide 402 termination comprising coupling port 404, feed 410, and the radiating component 408. The feed 410 may be mounted on a PCB 406 (e.g., the feed 410 may be metallic traces on a PCB). The PCB may be mounted to a bottom surface of a split-block waveguide antenna like that shown in FIG. 2D. Furthermore, FIG. 4A illustrates one example use of a coupling port 404. The coupling port 404 may also be used in instances other than the presently disclosed antenna apparatus. For example, the coupling port 404 may be used in any instance where an electromagnetic signal is being coupled into and/or out of a waveguide. Further, the coupling port 404 as disclosed herein may also be used to efficiently couple a signal from a PCB to a radiating structure, like an antenna, without the use of the waveguide beamforming network.

Figure 4B:
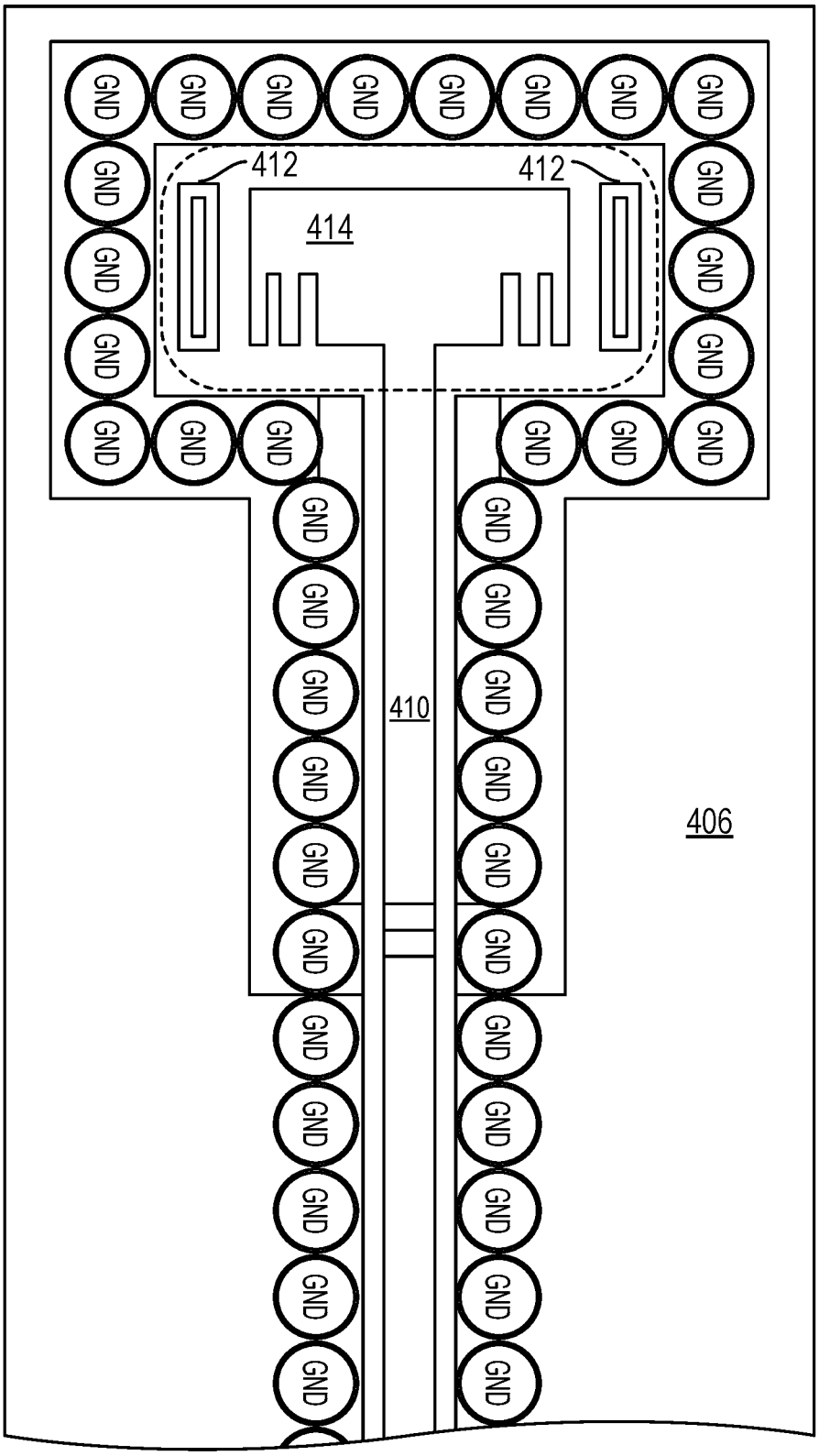
FIG. 4B illustrates top-down view of a PCB-mounted coupling structure, in accordance with an example embodiment.
Figure 4C:
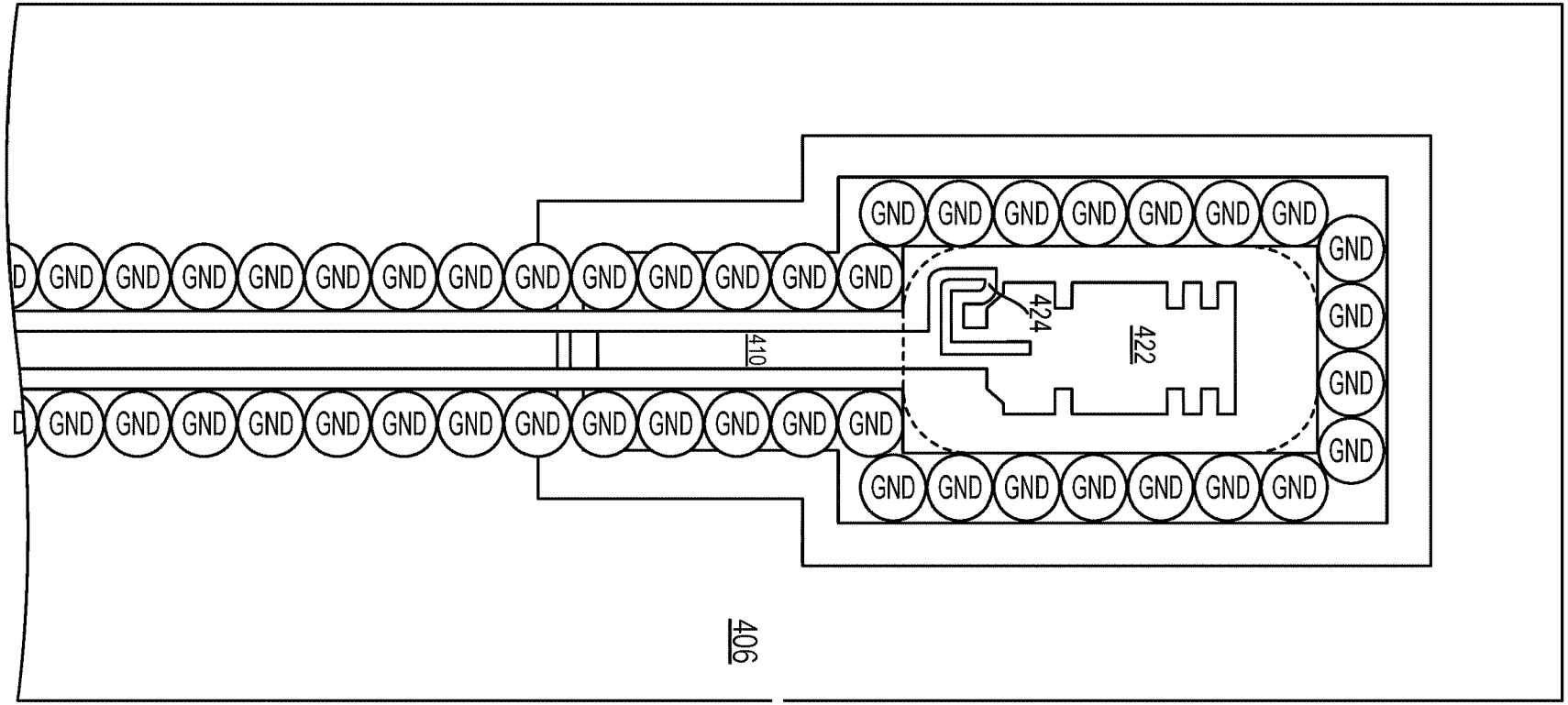
FIG. 4C illustrates top-down view of a PCB-mounted coupling structure, in accordance with an example embodiment.
Figure 4D:
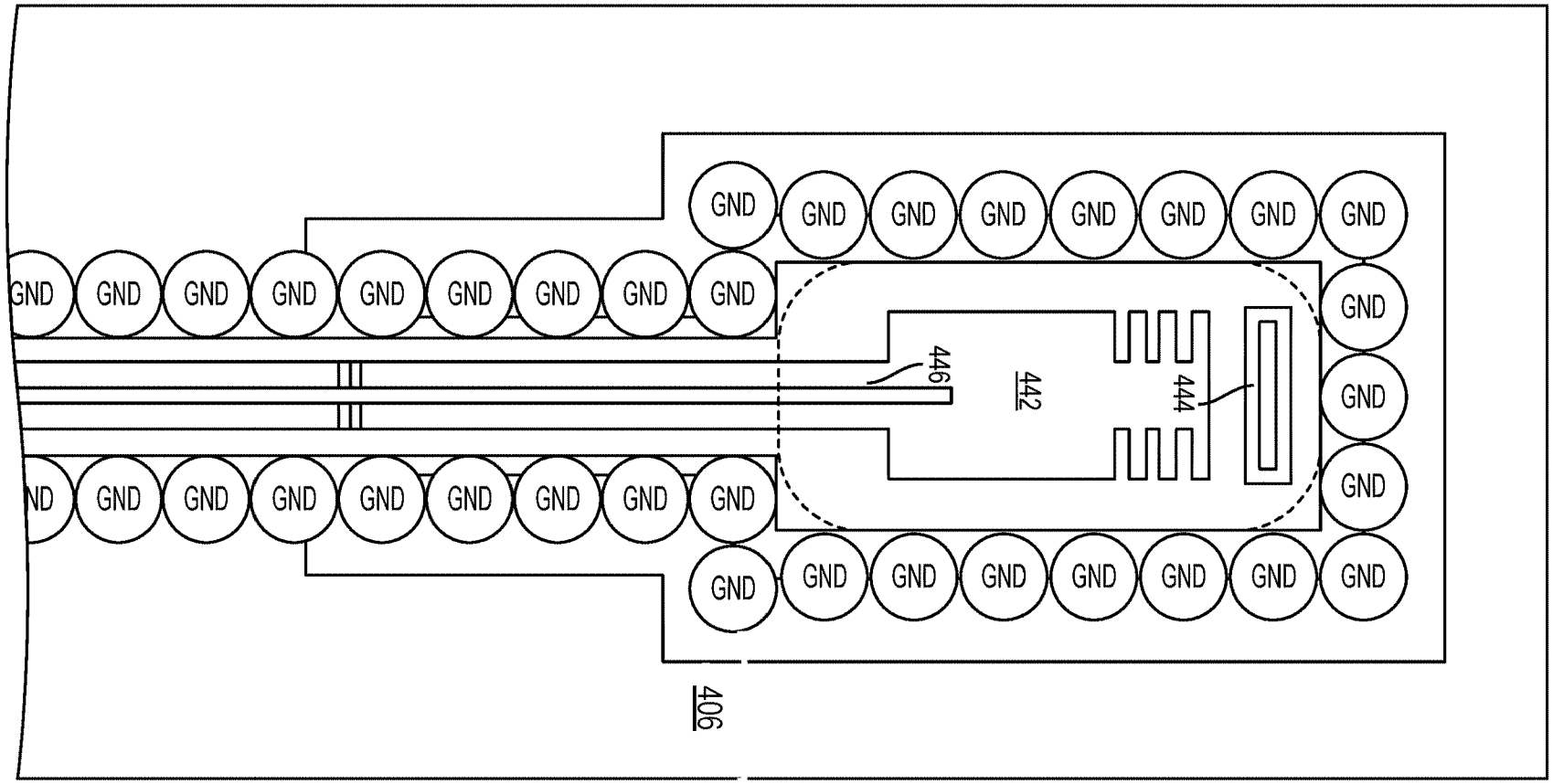
FIG. 4D illustrates top-down view of a PCB-mounted coupling structure, in accordance with an example embodiment

Although FIG. 4A is shown with the radiating component 408 coupled to a singled ended feed 410, in other examples, the radiating component 408 may be a different shape, such as a single patch (as discussed with respect to FIGS. 4B-4D). Additionally, the radiating component 408 may be a bidirectional component that may be able to both feed an electromagnetic signal into the coupling port for transmission by the antenna unit and couple an electromagnetic signal from the waveguide to a feed. Additionally, the radiating component 408 is shown as a patch in FIG. 4A. However, FIG. 4B-4D disclose several different shapes for the radiating component 408 that include both electric field and magnetic field radiating portions. Radiating component 408 is shown for a discussion of the coupling of a signal from the radiating component 408 into the waveguide 402.

The waveguide 402 of FIG. 4A may be a portion of a waveguide elongated segments, such as elongated segments 204 of FIG. 2A. More specifically, the waveguide 402 of FIG. 4A may be one of the elongated segments that does not include the feed. The coupling port 404 may be aligned perpendicularly, and out of the plane of the waveguide 402. The coupling port 404 may be configured to couple the electromagnetic energy to a feed 410 located on a PCB 406 by way of a radiating structure 408. The feed 410 may be coupled to radio hardware electronics. The radio hardware electronic may be a RADAR transceiver configured to send and receive radio signals from the feed 410.

In some examples, such as shown in FIG. 4A, each coupling port 404 may be shaped in a way to match (or approximately match) an impedance of the waveguide to an impedance of the radiating structure 408. By impedance matching, the amount of the reflected electromagnetic energy that is coupled from the waveguide 402 to the coupling port 404 may be maximized. For example, the coupling port 404 may have portions that are of different dimensions to achieve the correct impedance matching. Further, in instances where an antenna unit has multiple coupling ports, each coupling port may have its own dimensions based on the impedance match desired for each respective coupling port. In yet some further examples, the radiating structure 408 may be designed to have an impedance that matches the impedance of the coupling port 404. In some examples, the electric field and magnetic field coupling components of the radiating structure 408 may have a different shape and/or placement in order to adjust the impedance of the radiating structure 408.

Additionally, the coupling port 404 and radiating structure 408 are shown coupling to the bottom of the waveguide. In other examples, the alignment of the coupling port 404, PCB 406, and radiating structure 408 may have a different alignment. For example, the coupling may be to a side or end of a waveguide as well.

To create the coupling port 404, the coupling port 404 may be machined from both the top side of the coupling port 404 and the bottom side of the coupling port 404. By designing a coupling port 404 that has dimensions that can be machined from both sides, a coupling port 404 may be created that performs the impedance matching function while also being relatively simple to manufacture. More complex versions of the coupling port may be designed as well, but having a port that may be machined from both the top and bottom side of the coupling port may decrease machining complexity.

As previously discussed, the radiating structure 408 is configured to couple at least a portion of the electromagnetic energy from the waveguide to the feed 408 through the coupling port 404. In this way, when the radiating structure 408 couples the at least a portion of received electromagnetic energy, the radiating structure 408 may essentially act as a receiving antenna. The radiating structure 408 receives the at least a portion of the received electromagnetic energy from the waveguide and couples it through the coupling port.

In other examples, the coupling port 404 may function to inject electromagnetic energy into the waveguide. In this example, radiating structure 408 is configured to couple at least a portion of the electromagnetic energy from feed trace 410 on the PCB 406 to the waveguide 402 through the coupling port 404. In this way, when the radiating structure 408 couples the at least a portion of the electromagnetic energy, the radiating structure 408 may essentially act as a transmitting antenna. The radiating structure 408 transmits at least a portion of the electromagnetic energy from the feed traces and couples it through the coupling port.

In various different examples, the radiating structure 408 may take different forms. For example, the radiating structure 408 may be a metallic patch-shaped structure, as shown in FIG. 4A. The radiating structure 408 may function similarly to an antenna, that is the radiating structure 408 may be able to transmit or receive electromagnetic energy (i.e., a wave). Functionally, in one example, the radiating structure 408 may be a component configured to convert a guided wave from a waveguide to a guided wave outside of the waveguide (e.g., couple the wave to a feed). In another example, the radiating structure 408 may be a component configured to convert a guided wave from outside the waveguide to a guided wave in a waveguide.

In various examples, the radiating structure 408 may be made in various ways and with various materials and shapes. There are many structures that can function to cause the conversion of the wave from a wave in the waveguide to a wave not in the waveguide and can take the place of radiating component 408 (such as coupling component 412 of FIG. 4B).

As shown in FIG. 4B, the radiating structure 408 may be a metallic trace (or patch) on the circuit board 406. However, in other examples, the coupling component may be a discrete component attached to the PCB. For example, the coupling component may be formed of a ceramic that is coated, plated, or otherwise overlaid with metal. The radiating component 408 may also be formed from stamped metal, bent metal, or other another metal structure. In some additional examples, the radiating component 408 may itself be a metallic strip or component on a second circuit board that may be surface mounted to PCB 406.

In some examples, the radiating structure 408 may be a bi-directional coupler that functions to both (i) couple a signal from outside the waveguide into the waveguide and (ii) couple signal from inside the waveguide out of the waveguide.

In some further examples, the radiating structure 408 may be configured to couple a differential mode signal from outside the waveguide into the waveguide. In some additional examples, the radiating structure 408 may be configured to couple a signal from inside the waveguide out of the waveguide as a differential mode signal.

In some additional examples, the radiating structure 408 may be configured to couple a single mode signal from outside the waveguide into the waveguide. In some additional examples, the radiating structure 408 may be configured to couple signal from inside the waveguide out of the waveguide as a single mode signal.

In various embodiments, the radiating structure 408 may be designed to have an impedance that optimizes the percentage of electromagnetic energy that the radiating structure 408 couples between its input and output.

FIG. 4B shows a top-down view of a radiating structure that includes both an electric field coupling component 414 and two magnetic field coupling components 412 on a circuit board 406. As previously discussed, a feed 410 may feed a signal to an electric field radiating component 414. The signal radiated by the electric field radiating component 414 may couple to both the magnetic field radiating components 412. The magnetic field radiating components 412 in turn may reradiate a signal. As shown in FIG. 4B, the electric field radiating component 414 is a modified rectangular patch. The patch features two cuts on each side of the feed 410. The cuts in the patch function to both increase a bandwidth of the patch as well as provide some impedance matching. The two magnetic field coupling components 412 may be loops that are mounted on a surface of the circuit board 406. The two magnetic field coupling components 412 provide a further increase a bandwidth as well as some impedance matching for the radiating component as a whole.

Further shown in FIG. 4B are grounding points labeled as GND. The grounding points GND are points that may be used to introduce an electrical ground to the PCB 406. The grounding points GND may form an electrical contact with the waveguide block, such as the bottom of waveguide block shown in FIG. 2D.

The feed 410 is disposed on a circuit board 406 located outside of, or on an external surface of, the waveguide block structure. When the waveguide antenna block is functioning to receive RADAR signals, the feed 410 may receive the at least a portion of the received electromagnetic energy from the radiating structure 408. When the waveguide antenna block is functioning to transmit RADAR signals, the feed 410 may propagate electromagnetic energy to the radiating components for coupling into a waveguide.

FIG. 4C shows a top-down view of a radiating component that includes both an electric field coupling component 422 and a magnetic field coupling component 424 on a circuit board 406. The electric field coupling component 422 and magnetic field coupling component 424 may function similar to those previously discussed. FIG. 4C also include ground points GND that are similar to those discussed with respect to FIG. 4B. A feed 410 may feed a signal to the radiating component. The feed 410 may feed both the electric field coupling component 422 and the magnetic field coupling component 424 directly.

As shown in FIG. 4C, the electric field radiating component 422 is a modified rectangular patch. The patch features three cuts on each side of the patch. The cuts in the patch function to both increase a bandwidth of the patch as well as provide some impedance matching. The magnetic field radiating component 424 may be loops coupled to the feed 410 electric field radiating component 422. The magnetic field radiating components 424 provide a further increase a bandwidth as well as some impedance matching for the radiating component as a whole.

FIG. 4D shows a top-down view of a radiating component that includes both an electric field coupling component 442 and a magnetic field coupling component 444 on a circuit board 406. The electric field radiating component 442 and a magnetic field radiating component 444 may function similar to those previously discussed. FIG. 4D also include ground points GND that are similar to those discussed with respect to FIG. 4B. A feed 446 may feed a signal to the radiating component. In FIG. 4D the feed 446 is shown as a differential feed, that is it has two lines that feed a differential signal to the radiating component. Based on a desired configuration the differential feed 446 may be replaced with a single ended feed as shown in FIGS. 4A-4C. Similarly, the examples shown in FIGS. 4A-4C may use a differential feed in some examples as well. The feed 446 may feed both the electric field radiating component 442 and the magnetic field radiating component 444 directly.

When the differential feed 446 feeds a signal to the electric field radiating component 442, the electric field radiating component 442 may radiate at least a portion of the signal. The signal radiated by the electric field radiating component 442 may couple to the magnetic field radiating component 444. The magnetic field radiating components 444 in turn may reradiate a signal.

As shown in FIG. 4D, the electric field radiating component 442 is a modified rectangular patch. The patch features three cuts on each side of the patch. The cuts in the patch function to both increase a bandwidth of the patch as well as provide some impedance matching. The magnetic field radiating component 444 may be a loop that couples to a signal radiated by the electric field radiating component 442 and reradiates a signal. The magnetic field radiating components 444 provide a further increase a bandwidth as well as some impedance matching for the radiating component as a whole.

It should be understood that other shapes and dimensions of the waveguide channels, portions of the waveguide channels, sides of the waveguide channels, wave-directing members, and the like are possible as well. In some embodiments, a rectangular shape of waveguide channels may be highly convenient to manufacture, though other methods known or not yet known may be implemented to manufacture waveguide channels with equal or even greater convenience.

It should be understood that arrangements described herein are for purposes of example only. As such, those skilled in the art will appreciate that other arrangements and other elements (e.g., machines, apparatuses, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the scope being indicated by the following claims.

What is claimed is:

1. An apparatus comprising:

a feed located on a circuit board configured to propagate an electromagnetic signal;

a waveguide configured to propagate the electromagnetic signal;

a coupling port configured to couple the electromagnetic signal between the circuit board and the waveguide, wherein the circuit board is proximate to the coupling port; and a radiating structure disposed on the circuit board and coupled to the feed, wherein the radiating structure comprises an electric field coupling component and a magnetic field coupling component, wherein the electric field coupling component is configured to couple an electric field between the circuit board and the coupling port, and wherein the magnetic field coupling component is configured to couple a magnetic field between the circuit board and the coupling port and wherein the magnetic field coupling component is physically separated from the electric field coupling component.

2. The apparatus according to claim 1, wherein the magnetic field coupling component is in physical contact with the electric field coupling component.

3. The apparatus according to claim 1, wherein the magnetic field coupling component comprises a loop.

4. The apparatus according to claim 1, wherein the electric field coupling component comprises a patch.

5. The apparatus according to claim 1, wherein the coupling port is configured as a bidirectional port.

6. The apparatus according to claim 1, wherein the waveguide comprises one or more radiating structures configured to radiate electromagnetic energy from the waveguide and/or couple electromagnetic energy into the waveguide.

7. The apparatus according to claim 1, wherein the waveguide comprises a first metal layer and a second metal layer, and wherein the circuit board is coupled to the first metal layer.

8. The apparatus according to claim 7, wherein the coupling port is located in the first metal layer.

9. A method comprising:

conducting electromagnetic energy by a feed of a circuit board, wherein the circuit board is proximate to a coupling port of a waveguide;

radiating at least a portion of the electromagnetic energy from the feed as radiated electromagnetic energy by a radiating structure disposed on the circuit board, wherein the radiating structure is coupled to the feed and comprises an electric field coupling component and a magnetic field coupling component; and coupling at least a portion of the radiated electromagnetic energy into the waveguide via the coupling port, wherein coupling the portion of the radiated electromagnetic energy into the waveguide via the coupling port comprises:

coupling an electric field from the circuit board into the coupling port by the electric field coupling component; and coupling a magnetic field from the circuit board into the coupling port by the magnetic field coupling component, wherein the magnetic field coupling component is physically separated from the electric field coupling component.

10. The method according to claim 9, wherein the magnetic field coupling component is in physical contact with the electric field coupling component.

11. The method according to claim 9, wherein the magnetic field coupling component comprises a loop and the electric field coupling component comprises a patch.

12. The method according to claim 9, wherein the waveguide comprises a first metal layer and a second metal layer, and wherein the circuit board is coupled to the first metal layer.

13. The method according to claim 12, wherein the coupling port is located in the first metal layer.

14. A method comprising:

propagating electromagnetic energy by a waveguide;

receiving at least a portion of the electromagnetic energy from the waveguide into a coupling port as received electromagnetic energy;

coupling at least a portion of the received electromagnetic energy from the coupling port to a radiating structure disposed on a circuit board, wherein the radiating structure is coupled to a feed disposed on the circuit board, and wherein coupling the portion of the received electromagnetic energy from the coupling port to the radiating structure comprises:

coupling an electric field from the coupling port to the circuit board by an electric field coupling component of the radiating structure disposed on the circuit board; and coupling a magnetic field from the coupling portion to the circuit board by a magnetic field coupling component of the radiating structure disposed on the circuit board, wherein the magnetic field coupling component is physically separated from the electric field coupling component; and conducting, in the feed, the portion of the received electromagnetic energy coupled to the radiating structure.

15. The method according to claim 14, wherein the magnetic field coupling component is in physical contact with the electric field coupling component.

16. The method according to claim 14, wherein the magnetic field coupling component comprises a loop and the electric field coupling component comprises a patch.

17. The method according to claim 14, wherein the waveguide comprises a first metal layer and a second metal layer, wherein the circuit board is coupled to the first metal layer, and wherein the coupling port is located in the first metal layer.

* * * * *